US005787947A

United States Patent [19]

Hertsgaard

[11] Patent Number: 5,787,947

[45] Date of Patent: Aug. 4, 1998

[54] FLEXIBLE NOZZLE INTEGRATED WITH A TRANSFORMABLE WIRE

[75] Inventor: John Hertsgaard, Minneapolis, Minn.

[73] Assignee: Tetra Laval Holdings & Finance S.A., Pully, Switzerland

[21] Appl. No.: 752,135

[22] Filed: Nov. 19, 1996

[51] Int. Cl.[6] ..... B65B 1/04; B65B 3/00; B67C 3/00

[52] U.S. Cl. ..... 141/392; 141/114; 141/255; 222/494; 251/11

[58] Field of Search ..... 141/114, 286, 141/255, 392; 222/494; 60/527, 528; 251/11; 137/468; 239/75, 602, DIG. 12

[56] References Cited

U.S. PATENT DOCUMENTS

| | | | |
|---|---|---|---|
| 1,697,432 | 1/1929 | Martin | 60/528 |
| 2,926,293 | 2/1960 | Camm et al. | 318/117 |
| 2,998,198 | 8/1961 | Young | 239/455 |
| 3,174,851 | 3/1965 | Buehler et al. | 75/170 |
| 3,254,869 | 6/1966 | Easey | 251/4 |
| 3,335,963 | 8/1967 | Weis | 239/499 |
| 3,358,932 | 12/1967 | Wilhite | 239/265.43 |
| 3,365,240 | 1/1968 | Gordon | 222/494 |
| 3,465,967 | 9/1969 | Card | 239/265.23 |
| 3,534,908 | 10/1970 | Coleman et al. | 239/265.43 |
| 3,635,016 | 1/1972 | Benson | 60/23 |
| 3,776,470 | 12/1973 | Tsuchiya | 239/534 |
| 4,002,954 | 1/1977 | Orlando | 318/117 |
| 4,302,939 | 12/1981 | Golestaneh | 60/527 |
| 4,501,058 | 2/1985 | Schatzler | 29/446 |
| 4,877,160 | 10/1989 | Derving | 222/494 |
| 4,899,910 | 2/1990 | Tabei et al. | 60/527 |
| 4,973,024 | 11/1990 | Homma | 251/11 |
| 5,105,997 | 4/1992 | Wakabayashi et al. | 222/494 |
| 5,309,961 | 5/1994 | Franke et al. | 141/286 |

*Primary Examiner*—Henry J. Recla
*Assistant Examiner*—Timothy L. Maust
*Attorney, Agent, or Firm*—Michael A. Catania

[57] ABSTRACT

A flexible nozzle integrated with a transformable wire which provides for a greater opening of the nozzle during the distribution of a desired contents into a container. The greater opening reduces the velocity of the desired content thereby reducing or eliminating frothing which may hamper the sealing of the container. The transformable wire may be composed of a marmem material or a piezoelectric material. A marmem material is a shape memory alloy. For example, the marmem material may be a nitinol alloy. If a marmem material is utilized, the wire is heated above the marmem material's critical temperature in order to open the nozzle. As the desired contents flow through the nozzle, the marmem material is cooled below its critical temperature and transformed to a second shape thereby closing the nozzle. The process is repeated for each container to be filled with the desired contents.

22 Claims, 4 Drawing Sheets

FLEXIBLE NOZZLE INTEGRATED WITH A TRANSFORMABLE WIRE

TECHNICAL FIELD

The present invention relates to flexible nozzles for the dispensing of liquids. Specifically, the present invention relates to flexible nozzles for the dispensing of liquids utilizing a marmem wire.

BACKGROUND

In the production of certain types of containers for flowable materials, the containers are filled with the aid of metering pumps such as piston pumps. On each pump stroke, the pump portions out the desired quantity of contents to a vertical filler pipe connected to the pump. The filler pipe directs the contents down into a container which is to be filled. In such instance, the package may possibly be raised so that it partially surrounds the vertical filler pipe. The discharge opening of the vertical filler pipe is normally provided with a nozzle in order to prevent the contents from leaving the filler pipe too early and to avoid dripping after the portioning operation of the desired quantity of contents. The nozzle may include means for retaining the column of liquid contents in the filler pipe when the pump is inactive. Such means may, for example, be a nozzle of a flexible material such as an elastomer. The nozzle may have one or more flaps or folds which, during the operative stroke of the pump, are brought into the opened position by the passing liquid contents. A valve unit with a nozzle of this type is disclosed in Franke et al, U.S. Pat. No. 5,309,961 for a Nozzle For Filler Pipes In Packaging Machines.

The nozzle disclosed in the above patent specification has proved to ideally be suitable for use in the portioning out of free flowing, frothy contents such as low fat milk or skimmed milk. When dispensing such contents, froth formation should be avoided to prevent the obstruction of filling cycle and to prevent the possibility that the interior surfaces at the upper region of the container, which are to be subsequently employed for sealing the top of the container, become moist so as to impede or prevent the heat sealing of the mutually facing thermoplastic layers of the container. The froth formation has been prevented in the Franke et al nozzle because this nozzle has a central rigidifying rib which forms two or more discrete outlets each one of which has a separate flap. In the Franke et al nozzle, the flow of the contents is divided into two or more partial flows which are directed obliquely outwardly towards the vertical interior surfaces of the container and may thereby flow along these surfaces downwardly towards the bottom of the container or the progressively rising level of the liquid surface.

Marmems (the contraction of martensitic and memory), also known as shape memory alloys, have an unique inherent property which make them an attractive material for many applications. This property is the ability to be transformed from an original shape to a transformation shape then return to the original shape upon reaching a martensitic critical temperature for the alloy. Hence, the designation shape memory alloys. The marmems are capable of undergoing a martensitic transition through both temperature and stress. Each marmem has its own particular martensitic critical temperature at which the transformation occurs to return the material to its original shape. At temperatures below their critical temperatures, these marmems are relatively soft and pliable. Annealed at a temperature above its critical temperature in a given shape and deformed into a second configuration at a temperature below that critical temperature, such a marmem will revert back to its original configuration when heated to or above its critical temperature. This process is named shape-recovery since the marmem will move in a direction opposite to the direction in which it had been deformed and in so doing will recover its original shape. This shape recovery is found to occur with some force supplied by a part of the martensitic latent heat of transformation which is approximately 2 cal/g. Marmems are available that possess critical temperatures in the range of −150° C. to +150° C. The marmems of one such group, referred to as 55-Nitinol, have chemical compositions in the range of approximately 53 to 57 percent weight nickel, with the balance composed of titanium. Nitinol was invented in the early 60s by W. J. Buehler and Raymond C. Wiley while at the Naval Surface Warfare Center. Their invention is embodied in U.S. Pat. No. 3,174,851. Nitinol has been used in many applications since the 60s, in such areas as heat engines and medical instruments.

SUMMARY OF THE INVENTION

The present invention provides a novel approach to the problem of frothing during the dispensing of a desired contents into a container. The present invention increases the diameter and cross-sectional area of a flexible nozzle thereby reducing the velocity of the contents entering the container. This reduction in velocity greatly reduces the frothing of a desired contents such as low-fat milk. The present invention also decreases dripping after the desired contents have been dispensed into the container. The present invention is able to accomplish this through the integration of a transformable wire with the flexible nozzle.

One aspect of the present invention is a flexible nozzle for the dispensing of a flowable material into a container. The flexible nozzle comprises a cone portion, a transformable wire integrated into the cone portion and means for actuating the transformable wire. The cone portion may be further divided into a plurality of flaps, with each of the plurality of flaps integrated with the transformable wire. The transformable wire may be composed of a marmem material selected from group consisting of nitinol. Alternatively, the transformable wire may be composed of a piezoelectric material. The flexible nozzle may further comprise means for resuctioning of the flowable material. The means for actuating the transformable wire may be a transmission of heat to the transformable wire. Alternatively, the means for actuating the transformable wire may be a transmission of electricity to the transformable wire. The flexible nozzle may further comprise a source of electricity connected to the transformable wire.

The actuation of the transformable wire transforms the transformable wire from a contracted shape to an extended shape and thereby the transformable wire extends the perimeter of the cone portion further than the extension of the perimeter of the cone portion through the downward flow of the flowable material alone. More specifically, the actuation of the marmem wire transforms the marmem wire from a deformed shape to a trained shape and thereby the marmem wire extends the perimeter of the cone portion further than the extension of the perimeter of the cone portion through the downward flow of the flowable material alone.

Another aspect of the present invention is a method for opening and closing a flexible nozzle for the dispensing of a flowable material into a container. The first step of the method is to dispense a flowable material to a closed flexible nozzle. The flexible nozzle having a cone portion integrated with a transformable wire. The next step is to actuate the transformable wire. The next step is extending the perimeter of the cone portion through the actuation of the transformable wire from a contracted shape to an extended shape. The next step is dispensing the flowable material into the container which is followed by the step of contracting the transformable wire. The final step is closing the flexible nozzle through the return of the transformable wire to the contracted shape.

The cone portion utilized in the method may be further divided into a plurality of flaps integrated with the transformable wire. The transformable wire utilized in the method may be composed of a marmem material. Alternatively, the transformable wire may be composed of a piezoelectric material. The method may further comprise the step of resuctioning the flowable material subsequent to the step of closing the flexible nozzle. The step of actuating of the transformable wire may be through a transmission of heat to the transformable wire. Alternatively, the step of actuating the transformable wire may be through a transmission of electricity to the transformable wire.

In performing the method, the actuation of the marmem wire transforms the marmem wire from a deformed shape to a trained shape and thereby the marmem wire extends the perimeter of the cone portion further than the extension of the perimeter of the cone portion through the downward flow of the flowable material alone. The method may still further comprise a step of metering a predetermined quantity of the flowable material prior to the step of dispensing the flowable material.

Having briefly described this invention, the above and further objects, features and advantages thereof will be recognized by those skilled in the pertinent art from the following detailed description of the invention when taken in conjunction with the accompanying drawings.

BRIEF DESCRIPTION OF THE DRAWINGS

Several features of the present invention are further described in connection with the accompanying drawings in which:

There is illustrated in FIG. 1 a bottom perspective of one embodiment of the present invention.

Figure 2A:
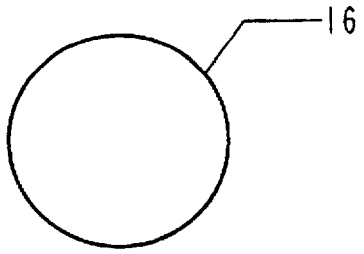

There is illustrated in FIG. 2A a top perspective of a wire of the present invention in a shape for expansion of the nozzle.

Figure 2B:
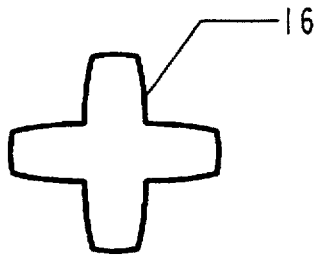

There is illustrated in FIG. 2B a top perspective of a wire of the present invention in a shape for contraction of the nozzle.

Figure 3:
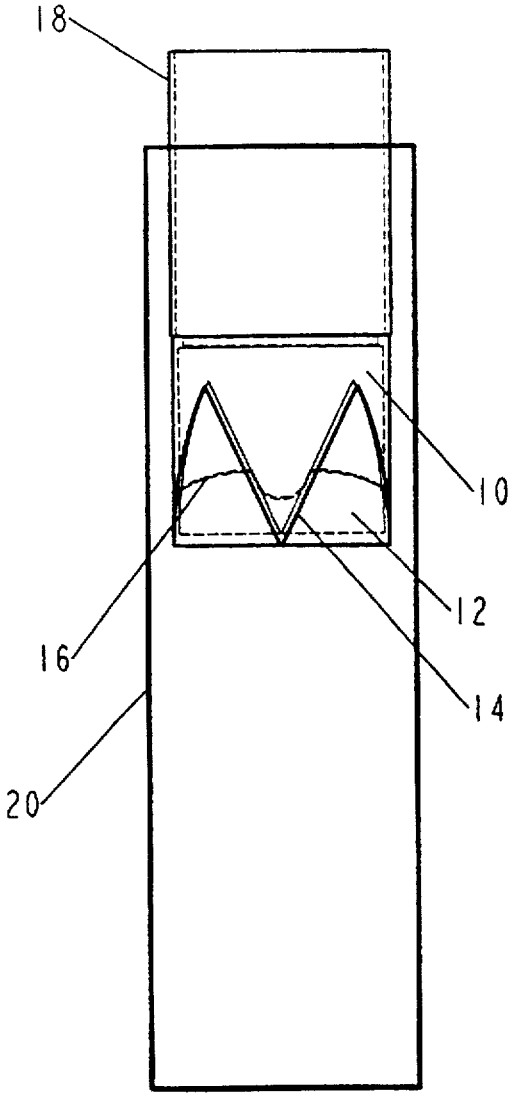

There is illustrated in FIG. 3 a side perspective of one embodiment of the present invention in an open state.

Figure 4:
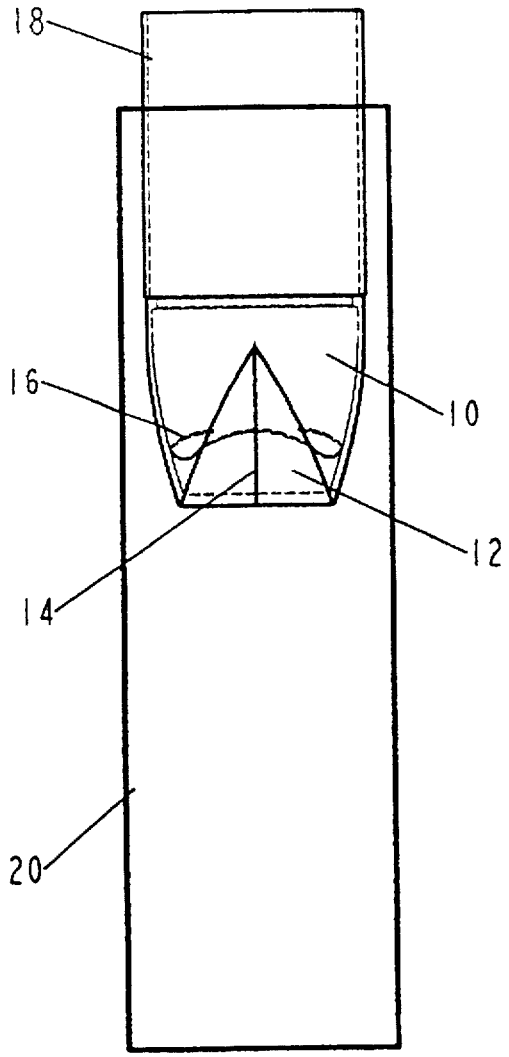

There is illustrated in FIG. 4 a side perspective of one embodiment of the present invention in a closed state.

Figure 5:
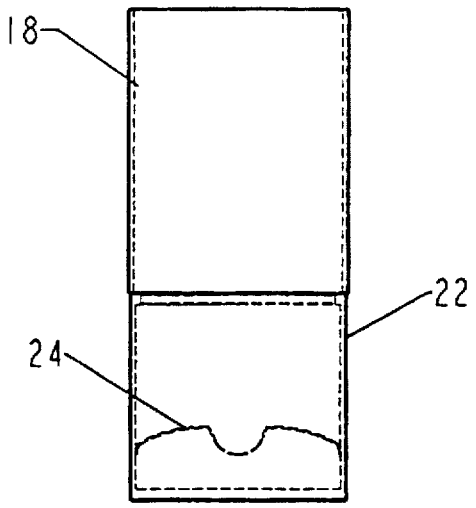

There is illustrated in FIG. 5 a side perspective of an alternative embodiment of the present invention.

DETAILED DESCRIPTION OF THE PREFERRED EMBODIMENTS

When the flexible nozzle according to the present invention is employed in a filling machine, it is mounted to the lower end of a preferably cylindrical filler pipe of stainless steel or other suitable material. The filler pipe may also be of quadratic or other cross section. The filler pipe is placed in a filling machine such that containers may be advanced at regular intervals by means of a conveyor and placed beneath the filler pipe. The present invention may have application in a continuous motion machine also. When filling is to take place, the container may or may not be raised so that it partially surrounds the filler pipe. Raising of the container is to decrease frothing or splashing of the contents. The contents will flow from a metering pump through the flexible nozzle. In the past, the contents have had to solely provide the force necessary to open the flaps of the nozzle. This force provided by the contents has not been sufficient to thoroughly open the flaps to reduce flow velocities and therefore foam formation. The nozzle of the present invention provides a farther opening of the flaps than by contents flow alone thereby reducing foam formation.

Figure 1:
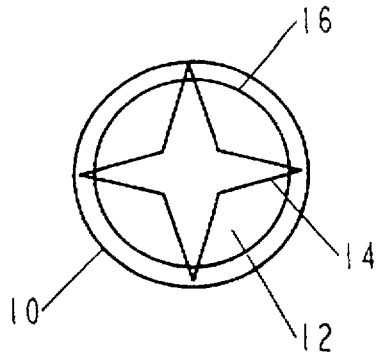

There is illustrated in FIG. 1 a bottom perspective of one embodiment of the present invention. As shown in FIG. 1, the flexible nozzle of the present invention is generally designated 10. The flexible nozzle 10 has four flaps 12 which when open, or partially open as shown, provide four slits 14 for the flow of a desired contents into a container. This embodiment of the present invention has four flaps 14, however those skilled in the art will recognize that other nozzles may have a greater or lesser number of flaps without departing from the scope of the present invention. Integrated into each of the four flaps is a single marmem wire 16. The marmem wire 16 may be "sewn" into each of the plurality of flaps 12 alternating between the interior and exterior of each of the plurality of flaps 12 at predetermined distances. Alternatively, the marmem wire 16 may be only attached to the interior or exterior of each of the plurality of flaps 12. The positioning of the marmem wire 16 is of some importance, and varies on the particular application of the nozzle 10. In a preferred embodiment, the marmem wire 16 is positioned on a horizontal plane on the nozzle 10 as a circular ring. As a circular ring, the marmem wire 16 should be positioned a distance lengthwise so as to fully extend each of the plurality of flaps 12 to an open position, and to contract each of the plurality of flaps 12 to a substantially closed position.

As mentioned above, a marmem material has the capability to be transformed from an original shape to a transformation shape then return to the original shape upon reaching a martensitic critical temperature for the alloy. In practicing the present invention, the marmem wire 16 is configured into an "original" shape at a temperature above its critical temperature. This original shape should be for the expanded or open state for the nozzle 10. A preferred shape is annular, in order to ensure maximum expansion of the plurality of flaps 12. At a temperature below the critical temperature, the marmem wire 16 should be deformed into a second shape. This second shape should be for the contracted or closed state for the nozzle 10. An example of a second shape for the marmem wire is illustrated in FIG. 2B.

There is illustrated in FIG. 2A a top perspective of a wire of the present invention in a shape for expansion of the nozzle. There is illustrated in FIG. 2B a top perspective of a wire of the present invention in a shape for contraction of the nozzle. As shown in FIG. 2B, the marmem wire 16 has a sinusoidal annular configuration which allows for contraction of the nozzle 16, not shown. The sinusoidal configuration allows for a smooth transition from the straight annular shape as shown in FIG. 2A. Also, the deformation strain between configurations should not exceed 5 percent since this would result in the shape recovery becoming incomplete after relatively few cycles thereby rendering the invention useless. As is readily apparent from FIGS. 2A and 2B, the circumference of the marmem wire 16 does not change in the transformation from one shape to another. In practicing the present invention, the sinusoidal configuration has a reduced diameter in comparison to straight annular configuration of the marmem wire 16 as shown in FIG. 2A. This reduction in the diameter of the marmem wire 16 results in the contraction of the nozzle 10 as the integrated marmem wire 16 pulls the plurality of flaps 12 closed as the marmem wire 16 transforms from a straight annular shape to the sinusoidal annular shape. The shaping of the marmem wire 16 should take place prior to integration with the nozzle 10. Although one specific pair of shapes for the marmem wire 16 has been described for practicing the present invention, those skilled in the pertinent art will recognize that many other pairs of shapes may be employed in practicing the present invention without departing from the scope of the present invention.

There is illustrated in FIG. 3 a side perspective of one embodiment of the present invention in an open state. As shown in FIG. 3, the nozzle as described in FIG. 1 is partially inserted into a container 20 for filling thereof. In the open or expanded state, the marmem wire 16 is in a straight annular shape. The straight annular shape of the marmem wire 16 provides for a greater opening of the nozzle 10 than by the downward flow of the contents alone. This straight annular shape, or original shape is induced by the transmission of an electric current to the marmem wire from an outside source. The transmission of electricity heats the marmem wire 16 to a temperature above its critical temperature which results in the transformation of the marmem wire 16 from a deformed shape, the sinusoidal annular shape, to the original shape, the straight annular shape. This actuation of the marmem wire 16 may also take place through the transmission of heat from an outside source to the marmem wire 16. The critical temperature of the marmem wire 16 may vary over an extensive range. For example, most nitinol alloys, a preferred marmem, have a critical temperature between thirty to fifty degrees Celsius. A commonly used nitinol has a critical temperature of approximately 47° C. Several other shape-memory alloys that may be employed in practicing the present invention are copper-based shape memory alloys, aluminum-based shape memory alloys, chromium based shape-memory alloys, titanium-based shape memory alloys, nickel-based shape memory alloys, iron-based shape memory alloys, and any mixtures thereof.

In the open state, the nozzle 10 allows for a flow of the flowable material contents at a reduced velocity since the area of the opening for dispensing the flowable material contents into a container 20 is greater than the area resulting from the downward flow of the contents alone. In the case of a flowable material such as low fat milk, a reduction in the velocity reduces the foam formation in the container. By decreasing the foam formation, many production problems are resolved such as the prevention of seal portions of the container 20 becoming wet and thereby unsealable.

There is illustrated in FIG. 4 a side perspective of one embodiment of the present invention in a closed state. As shown in FIG. 4, the nozzle 10 is closed thereby preventing the dispersion of a flowable material. The closed state is brought about by the flow of the relatively cool flowable material contents into the container 20. As set forth above, the nozzle 10 is connected to the valve unit 18. The valve unit 18 may be in flow communication with a metering pump which controls the amount of flowable material to be dispensed into a container 20. The valve unit 18 may also have a resuctioning device which prevents after-dripping. Such a valve unit is disclosed in Derving, U.S. Pat. No. 4,877,160 for a Valve Unit which is hereby incorporated by reference.

Again referring back to FIG. 4, the marmem wire 16 is in the sinusoidal annular shape which has the lesser diameter, which forces inward the flaps 12 of the nozzle 10. The marmem wire 16 provides stiffening to the flaps 12 which also has the effect of resuctioning the flowable material thereby preventing dripping. The marmem wire 16 reverts to the sinusoidal shape by cooling the marmem wire 16 below its critical temperature. In a preferred embodiment, the transmission of electricity to the marmem wire 16 is continuous thus the marmem wire 16 will quickly reach its critical temperature after its cooling "bath" by the flowable material. It is readily obvious that the cooling and heating of the marmem wire should be indexed to the advancement of containers 20 and the metering of the flowable material. Another embodiment may have intermittent transmission of electricity or heat to the marmem wire 16 which is indexed to the above factors. The heating and cooling of the marmem wire 16 must be adjusted to match the application and most importantly the critical temperature of the particular marmem material.

Another embodiment of the present invention has the transformable wire composed of a piezoelectric material. A piezoelectric material expands its volume when a potential is applied to the material. In application with the present invention, the piezoelectric wire is integrated with a flexible nozzle in similar manner to marmem wire discussed above. Piezoelectric materials that may be used in practicing the present invention are quartz, rochelle salt and barium titanate. However, those skilled in the pertinent art will recognize that many other piezoelectric materials may be used in practicing the present invention without departing from the scope of the present invention.

There is illustrated in FIG. 5 a side perspective of an alternative embodiment of the present invention. As shown in FIG. 5, the cone shape nozzle is generally designated 22 and is integrated with a piezoelectric wire 24. Unlike the nozzle 10 previously discussed above, the nozzle 20 is a single unit without flaps 12. It should be noted that the marmem wire 16 discussed above may readily be used with this nozzle 22, or many other shapes of flexible nozzles. It should also be noted that the piezoelectric wire 24 may be utilized with the nozzle 10 as well as other flexible nozzle shapes. As a potential is applied to the piezoelectric wire 24, the wire 24 expands in volume thereby expanding the opening of the nozzle 22. Once the potential is removed, the volume of the piezoelectric wire contracts, thereby contracting the opening of the nozzle 22.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention the following:

1. A flexible nozzle for the dispensing of a flowable material into a container, the flexible nozzle connected to a fill pipe on one end, the fill pipe in flow communication with a source of the flowable material, the flexible nozzle comprising:

a cone portion formed by a plurality of flaps, each of the plurality of flaps extendable to engage with a sidewall of the container;

a transformable wire integrated into each of the plurality of flaps, the transformable wire comprising a marmem material; and means for actuating the transformable wire;

whereby actuation of the transformable wire extends individually each of the plurality of flaps to engage with a sidewall of the container.

2. The flexible nozzle according to claim 1 wherein the marmem material is selected from the group consisting of nitinol, copper-based shape memory alloys, aluminum-based shape memory alloys, chromium based shape-memory alloys, titanium-based shape memory alloys, nickel-based shape memory alloys, iron-based shape memory alloys, and any mixtures thereof.

3. The flexible nozzle according to claim 1 further comprising means for resuctioning of the flowable material.

4. The flexible nozzle according to claim 1 the means for actuating the transformable wire is a transmission of heat to the transformable wire.

5. The flexible nozzle according to claim 1 wherein the means for actuating the transformable wire is a transmission of electricity to the transformable wire.

6. The flexible nozzle according to claim 1 wherein the actuation of the transformable wire transforms the transformable wire from a contracted shape to an extended shape and thereby the transformable wire extends the tip of each of the plurality of flaps further than the extension of the tip of each of the plurality of flaps through the downward flow of the flowable material alone.

7. The flexible nozzle according to claim 6 wherein the actuation of the transformable wire transforms the marmem material from a deformed shape to a trained shape.

8. The flexible nozzle according to claim 6 wherein the contracted state of the transformable wire substantially eliminates dripping of the flowable material from the flexible nozzle.

9. The flexible nozzle according to claim 1 wherein the transformable wire is integrated into each of the plurality of flaps to form a sinusoidal annular configuration.

10. The flexible nozzle according to claim 1 wherein the engagement of each of the plurality of flaps with the sidewalls of the container decreases foaming from the flowable material being dispensed into the container.

11. A method for opening and closing a flexible nozzle for the dispensing of a flowable material into a container, the method comprising the steps of:

dispensing a flowable material to a closed flexible nozzle, the flexible nozzle having a cone portion, the cone portion integrated with a marmem wire;

actuating the marmem wire;

extending the perimeter of the cone portion through the actuation of the marmem wire from a contracted shape to an extended shape;

dispensing the flowable material into the container;

contracting the marmem wire; and closing the flexible nozzle through the return of the marmem wire to the contracted shape.

12. The method according to claim 11 wherein the cone portion is further divided into a plurality of flaps, each of the plurality of flaps integrated with the marmem wire.

13. The method according to claim 11 further comprising the step of resuctioning the flowable material subsequent to the step of closing the flexible nozzle.

14. The method according to claim 11 wherein the step of actuating of the marmem wire is through a transmission of heat to the marmem wire.

15. The method according to claim 11 wherein the step of actuating the marmem wire is through a transmission of electricity to the marmem wire.

16. The method according to claim 11 wherein the actuation of the marmem wire transforms the marmem wire from a deformed shape to a trained shape and thereby the marmem wire extends the perimeter of the cone portion further than the extension of the perimeter of the cone portion through the downward flow of the flowable material alone.

17. The method according to claim 11 further comprising a step of metering a predetermined quantity of the flowable material prior to the step of dispensing the flowable material.

18. The method according to claim 11 wherein the marmem material is selected firom the group consisting of nitinol, copper-based shape memory alloys, aluminum-based shape memory alloys, chromium based shape-memory alloys, titanium-based shape memory alloys, nickel-based shape memory alloys, iron-based shape memory alloys, and any mixtures thereof.

19. A method for opening and closing a flexible nozzle for the dispensing of a flowable material into a container, the method comprising the steps of:

dispensing a flowable material to a closed flexible nozzle, the flexible nozzle having a cone portion, the cone portion integrated with a piezoelectric wire;

actuating the piezoelectric wire;

extending the perimeter of the cone portion through the actuation of the piezoelectric wire from a contracted shape to an extended shape;

dispensing the flowable material into the container;

contracting the piezoelectric wire; and closing the flexible nozzle through the return of the piezoelectric wire to the contracted shape.

20. A flexible nozzle for the dispensing of a flowable material into a container, the flexible nozzle connected to a fill pipe on one end, the fill pipe in flow communication with a source of the flowable material, the flexible nozzle comprising:

a cone portion formed by a plurality of flaps, each of the plurality of flaps extendable to engage with a sidewall of the container;

a transformable wire integrated into each of the plurality of flaps, the transformable wire comprising a piezoelectric material; and means for actuating the transformable wire;

whereby actuation of the transformable wire extends individually each of the plurality of flaps to engage with a sidewall of the container.

21. A flexible nozzle utilized on a form, fill and seal packaging machine, the flexible nozzle attached to one end of a fill pipe which is connected to a source of flowable material on the other end, the flexible nozzle dispensing a predetermined quantity of the flowable material to a series of containers conveyed along a path, the flexible nozzle comprising:

a cone portion formed by a plurality of flaps, each of the plurality of flaps extendable to engage with a sidewall of the container;

a transformable wire integrated into each of the plurality of flaps, the transformable wire comprising a marmem material; and an actuator for transferring heat to the transformable wire;

whereby actuation of the transformable wire extends individually each of the plurality of flaps to engage with a sidewall of the container.

22. The flexible nozzle according to claim 21 wherein the flowable material is selected from the group comprising milk, soup, juice, water and yogurt.

* * * * *